United States Patent [19]

Yung-Mao

[11] Patent Number: 4,845,863

[45] Date of Patent: Jul. 11, 1989

[54] SHOE HAVING TRANSPARENT WINDOW FOR VIEWING CUSHION ELEMENTS

[75] Inventor: Lin Yung-Mao, Taichung, China

[73] Assignee: Autry Industries, Inc., Dallas, Tex.

[21] Appl. No.: 245,758

[22] Filed: Sep. 16, 1988

Related U.S. Application Data

[63] Continuation-in-part of Ser. No. 153,222, Feb. 8, 1988, which is a continuation-in-part of Ser. No. 25,010, Mar. 12, 1987, Pat. No. 4,233,483.

[51] Int. Cl.[4] ..... A43B 5/00; A43B 13/14; A43B 13/18

[52] U.S. Cl. ..... 36/114; 36/28; 36/30 R; 36/32 R; 36/136

[58] Field of Search ..... 36/28, 29, 43, 44, 3 R, 36/3 B, 14, 114, 30 R, 3 R, 15, 100, 101, 107, 136

[56] References Cited

U.S. PATENT DOCUMENTS

| | | | |
|---|---|---|---|
| Re. 32,412 | 5/1987 | Plagenheff . | |
| 220,475 | 10/1879 | Hannaford . | |
| D. 236,562 | 9/1975 | Wunsch et al. . | |
| D. 260,196 | 8/1981 | Plagenhoef . | |
| D. 263,518 | 3/1982 | Cohen . | |
| D. 265,017 | 6/1982 | Vermonet . | |
| D. 286,820 | 11/1986 | Lu . | |
| 379,579 | 3/1888 | Jensen . | |
| 418,966 | 1/1890 | Welander . | |
| 452,655 | 5/1891 | Valiant . . | |
| 485,180 | 11/1892 | Eastman . | |
| 578,794 | 3/1897 | Warner . | |
| 588,768 | 8/1897 | Kennedy . | |
| 660,522 | 10/1900 | Sharood . | |
| 746,862 | 12/1903 | Matson . | |
| 853,336 | 5/1907 | Ball . | |
| 863,873 | 8/1907 | Pratt . | |
| 896,488 | 8/1908 | Valiant . | |
| 940,856 | 11/1909 | Critz . | |
| 945,698 | 1/1910 | Conway . | |
| 1,029,110 | 6/1912 | Drobinski . | |
| 1,540,430 | 6/1925 | Sims . | |
| 1,559,532 | 10/1925 | Smith | 36/28 |
| 1,696,457 | 3/1928 | Shanahan . | |
| 1,932,557 | 10/1933 | Meucci . | |
| 1,974,456 | 9/1934 | Goldzweig . | |
| 1,981,300 | 11/1934 | Berg . | |
| 2,090,881 | 8/1937 | Wilson | 36/29 |
| 2,098,412 | 11/1937 | Bovay . | |
| 2,146,888 | 2/1939 | Fisch | 36/44 X |
| 2,153,304 | 4/1939 | Gruber . | |
| 2,200,849 | 5/1940 | Margolin . | |
| 2,343,700 | 3/1944 | Pickens et al. . | |
| 2,344,762 | 3/1944 | Wylie . | |
| 2,437,065 | 3/1948 | Austin . | |
| 2,457,944 | 1/1949 | Vlastos . | |
| 2,558,973 | 7/1951 | Meaker . | |

(List continued on next page.)

FOREIGN PATENT DOCUMENTS

| | | | |
|---|---|---|---|
| 3228017 | 7/1983 | Fed. Rep. of Germany | 36/3 R |
| 2454899 | 11/1980 | France | 36/136 |
| 59-168802 | 9/1984 | Japan | 36/25 R |
| 2007081 | 5/1979 | United Kingdom | 36/32 R |
| 2159038 | 11/1985 | United Kingdom | 36/101 |

OTHER PUBLICATIONS

"Nike Air Stab" Publication, Feb. 1988.

"Runner's World", Apr. 1988, on Reebok Energy Return System.

Runner's World, May 1988, vol. 23, No. 5, p. 19.

*Primary Examiner*—James Kee Chi

*Attorney, Agent, or Firm*—Baker, Mills & Glast

[57] ABSTRACT

A midsole (10 and 22) for an activewear shoe (12) comprises a removable insert (10) and a peripheral member (22). The peripheral member (22) is joined to the perimeter of an upper surface (18) of an outsole (14). A reinforcing layer (28) substantially less thick than the peripheral member (22) is joined to the outsole upper surface (18). A transverse reinforcing segment (30) is integrally formed with the peripheral member (22) to provide stability and support to a wearer of the shoe (12). Segment (30) forms a front receptacle (32) and a heel receptacle (34) dimensioned to receive insert (10). Insert (10) has a transverse slot (42) to match with the transverse segment (30). A plurality of independent cushioning elements (40) depend from a base member (38) of insert (10), and are sized in order to conform to the depth of peripheral member (22). The cushionability and resiliency of insert (10) may be selected according to the wearer's weight and cushionability preference.

9 Claims, 2 Drawing Sheets

U.S. PATENT DOCUMENTS 4,468,869 9/1984 Fukuoka .
4,509,510 4/1985 Hook .
4,510,704 4/1986 Johnson ..... 36/136
4,535,553 8/1985 Derderian et al. .
4,547,978 10/1985 Radford .
4,551,930 11/1985 Graham et al. .
4,571,853 2/1986 Medrano .
4,598,484 7/1986 Ma .
4,598,487 7/1986 Misevich .
4,610,099 9/1986 Signori .
4,611,412 9/1986 Cohen .
4,617,745 10/1986 Batra .
4,633,597 1/1987 Shiang .
4,697,362 10/1987 Wasserman ..... 36/136
4,712,314 12/1987 Sigoloff ..... 36/136 X
4,733,483 3/1988 Lin ..... 36/28
4,766,680 8/1988 Maciel et al. .
4,776,110 10/1988 Shiang .
4,817,304 4/1989 Parker et al. ..... 36/114
2,720,041 10/1955 Kajtar .
2,721,400 10/1955 Israel ..... 36/28 X
2,751,692 6/1956 Cortina .
2,759,284 8/1956 Santisi .
2,765,545 10/1956 Conrad, Sr. .
2,983,056 5/1961 Murawski .
2,985,971 5/1961 Murawski .
3,012,342 12/1961 Ramirez .
3,253,355 5/1966 Menken .
3,310,887 3/1967 Stokis .
4,000,566 1/1977 Famolare, Jr. .
4,043,058 8/1977 Hollister et al. .
4,045,886 9/1977 Terasaki .
4,063,371 12/1977 Batra .
4,075,772 2/1978 Sicurella .
4,078,321 3/1978 Famolare, Jr. .
4,095,353 6/1978 Foldes .
4,100,685 7/1978 Dassler .
4,103,440 8/1978 Lawrence ..... 36/101
4,112,599 9/1978 Krippelz .
4,123,855 11/1978 Thedford .
4,187,620 2/1980 Selner ..... 36/28
4,215,492 8/1980 Sandmeier .
4,223,455 9/1980 Vermeulen .
4,223,456 9/1980 Cohen .
4,236,326 12/1980 Inohara .
4,237,627 12/1980 Turner .
4,262,433 4/1981 Hagg .
4,263,728 4/1981 Frecentese .
4,297,796 11/1981 Stirtz et al. ..... 36/28
4,319,412 3/1982 Muller et al. ..... 36/29
4,342,157 8/1982 Gilbert .
4,347,673 9/1982 Svetlik ..... 36/30 R
4,397,104 8/1988 Doak .
4,408,401 10/1988 Seidel et al. .
4,430,810 2/1984 Bente .
4,438,573 3/1984 McBarron .
4,445,284 5/1984 Sakutori .

SHOE HAVING TRANSPARENT WINDOW FOR VIEWING CUSHION ELEMENTS

RELATED APPLICATION

This application along with copending U.S. application Ser. No. 207,202 filed June 16, 1988 is a continuation-in-part of co-pending U.S. application Ser. No. 153,222 filed Feb. 8, 1988, which in turn is a continuation-in-part of U.S. Pat. No. 4,733,483, Mar. 29, 1988, and is related to U.S. application Ser. No. 180,529 filed Apr. 12, 1988, which in turn is a continuation-in-part of U.S. application Ser. No. 097,806 filed Sept. 17, 1987, (now abandoned), which was a divisional of U.S. Pat. No. 4,733,483, Mar. 29, 1988.

TECHNICAL FIELD OF THE INVENTION

This invention relates in general to athletic or other activewear shoes, and more particularly relates to shoes having custom midsoles with a transverse reinforcement segment and a removable insert which coacts with said segment to provide improved stability and support.

BACKGROUND OF THE INVENTION

Athletic or other activewear shoes of a conventional construction generally have three or four separate parts. First, such shoes are provided with an outsole that is made of a durable material and that extends across the lower surface of the shoe. A midsole is joined to the outsole to provide a cushioning layer to the wearer's foot. Usually, an upper formed of leather, synthetics or other materials is joined to the midsole. In many conventional structures, an insole is further provided for disposal between the midsole and the wearer's foot for additional cushioning.

The midsoles of these conventional constructions have two undesirable characteristics. First, they have the property of deforming over a large area of surface when a downward force is impressed on them. Second, the midsoles are affixed to the shoes and therefore customers can make no choice in the midsole's cushionability without selecting another shoe. Thus, conventional midsoles do not offer anything in the way of independent suspension or deformation of various areas thereof, and further are suited to only a particular weight class or cushionability preference of wearers.

The need for a midsole having a plurality of cushioning elements, each demonstrating an individual suspension and deforming independently from the remaining elements has generally been met by the custom midsole as disclosed in U.S. Pat. No. 4,733,483, Mar. 29, 1988, to Lin. However, it has been found that a flat outsole and midsole as disclosed therein have a tendency to create a springboard effect which causes the heel to bounce and vibrate. Unless the midsole fits perfectly into the cavity created within the shoe, there is also a tendency for the midsole to slip therein. Thus, a need has arisen for a midsole that has a plurality of cushioning elements with individual suspension that does not slip or vibrate.

SUMMARY OF THE INVENTION

The present invention comprises a shoe having an outsole with an upper surface. A peripheral portion of a midsole is joined to the upper surface, and further forms a receptacle for the insertion of an insert. The peripheral portion and the insert are formed of a cushionable material. The insert is preferably formed to be laterally coextensive with the area on which most of the weight of the wearer's foot is received. The insert has a preselected cushionability that is selected according to the wearer's weight or cushionability preference. The selected insert is inserted into the receptacle, thus providing a custom midsole that is optimum for the customer's weight or cushioning preferences. An upper is joined to the peripheral portion of the midsole.

Another aspect of the invention comprises a midsole having an insert and a peripheral member disposed laterally outwardly of the insert. The insert has a lower surface with a plurality of convex cushioning elements formed to substantially fill at least a major portion of the insert lower surface. The elements are each operable to cushionably and independently deform responsive to downward force thereon. In a preferred embodiment, the upper surface of the midsole is joined to a fabric layer, which can be constructed out of a flocking material, such as can be made out of polyester and nylon.

In another aspect of the invention, the insert can be integrally formed with an insole member, the insole surface extending laterally over the peripheral member of the midsole.

In another embodiment of the invention, the insert has a plurality of convex elements formed in its upper surface as well as its lower surface. The convex elements are preferably in registry with respective lower elements.

According to a further aspect of the invention, the insert of the midsole is selected from a plurality of like inserts, each having a different durometer reading that is related to the member's cushionability. Thus, an insert can be selected by the customer that is optimum for his or her weight or cushioning preference.

Preferably, a footbed reinforcing layer is offered to the bottom of the receptacle prior to placing the insert therein. The footbed reinforcing layer is preferably much thinner than the depth of the receptable and provides torsional strength for lateral support of the wearer's foot.

In a preferred embodiment of the invention, the outsole and the midsole are each provided with a transverse segments for improved stability and support. The transverse segment separates the outsole into a front portion and a heel portion. The midsole is also separated into a front portion and a heel portion by a slot shaped to generally match the transverse segment. A transparent window is recessed into the heel portion of the outsole to provide visual observation of the convex elements.

BRIEF DESCRIPTION OF THE DRAWINGS

Various aspects of the invention and their advantages will be more completely understood by reference to the following Detailed Description in conjunction with the appended drawings in which.

DETAILED DESCRIPTION

Figure 1:
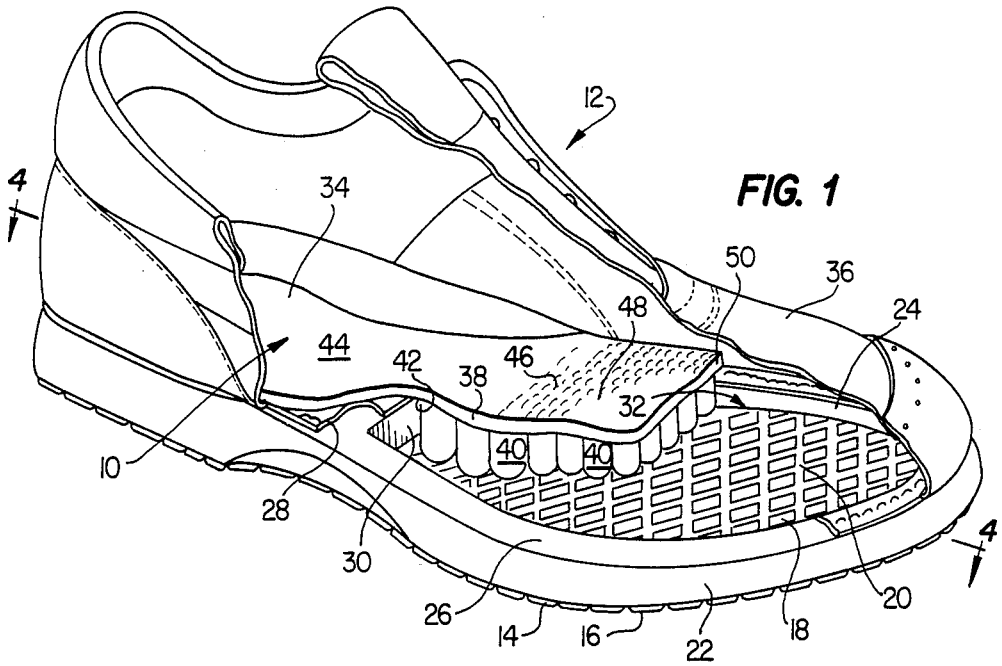
FIG. 1 is an isometric view of a shoe construction according to the invention as fitted with a custom midsole therefor, with parts broken away to show interior structure.

Referring first to FIG. 1, an isometric view of a preferred embodiment of a shoe construction according to the invention is shown. A custom midsole insert is indicated generally at 10. Insert 10 is shown as fitted into an active wear shoe indicated generally at 12. While the illustrated shoe 12 is one designed for walking, the invention can also be employed in other types of athletic shoes, such as running, aerobics, or court shoes. The invention also has application in any circumstance where varying midsole cushionability is desired.

Shoe 12 is comprised of an outsole 14 that forms the wearing surface of the shoe. Outsole 14 is preferably constructed of a relatively durable, resilient material such as natural rubber. Outsole 14 has an exterior surface that is provided with a suitable tread surface 16. Outsole 14 further has an interior or upper surface 18 which may be smooth and featureless throughout, or may have a central area 20 that is reticulated or webbed in order to save weight. A peripheral area (not shown) of upper surface 18 presents a smooth surface for gluing or other means of attachment.

A peripheral midsole member 22 is formed to be glued or otherwise attached to the peripheral area of outsole upper surface 18. Peripheral member 22 is more cushionable and yieldable than outsole 14, and can be conveniently molded of polyurethane foam or ethylene vinyl acetate copolymer (EVA). Peripheral member 22 is, in the illustrated embodiment, endless and extends completely around the periphery of outsole 14. Peripheral member 22 has an interior sidewall 24 and an upper surface 26.

While in the illustrated embodiment, peripheral member 22 is endless, this need not necessarily be the case. Member 22 can, for example, take the form of two longitudinal strips, one for each side of the shoe, or could take the form of several sections spaced around the periphery of the shoe. The form taken by peripheral member 22 should in any event perform its dual function of retaining insert 10 and provide structural support for the peripheral area of the shoe.

Preferably, a footbed reinforcing layer 28 is affixed as by gluing to outsole upper surface 18. Layer 28 is preferably much thinner than the height of peripheral member 22 so as to allow room for insert 10. Reinforcing layer 28 is sized to substantially coincide with the exposed portion of outsole upper surface 18.

Layer 28 is fabricated of a relatively resilient firm and less flexible material in relation to the EVA forming peripheral member 22. For example, layer 28 can be constructed of a leatherized paper or cardboard. The purpose of layer 28 is to replace torsional strength lost by the creation of peripheral midsole member 22. Thus, a midsole/outsole configuration having satisfactory torsional strength is formed for proper lateral support of the wearer's foot while at the same time providing for a central insert 10 having selectable cushionability.

Of particular importance to the present invention is a transverse reinforcing segment 30. Segment 30 is preferably integral with peripheral member 22 and formed from the same cushionable material (EVA). Segment 30 is preferably provided with a layer 28 on an upper surface thereof. Segment 30 is particularly useful for providing stability to the insert 10 and support to a wearer of the shoe 12. Without the segment 30, it has been found that vibrations, heel bounce and slippage of the insert 10 have occurred. The peripheral member 22 and the segment 30 form a front receptacle 32 and a heel receptacle 34 (covered in FIG. 1 by insert 10) that are dimensioned to receive insert 10.

Shoe 12 further comprises an upper 36 that can be fashioned of leather, cloth, synthetic materials or a combination of these, and is attached to upper surface 26 of peripheral member 22 by a method later described.

Insert 10 comprises an upper base member 38 and a plurality of supporting elements 40 that are preferably formed integrally with base member 38 to depend therefrom. As shown, elements 40 occupy receptacles 32 and 34 when insert 10 is installed into shoe 12. Elements 40 are dimensioned such that their depth matches the depth of sidewall 24 minus the thickness of layer 28, and are formed so as to occupy substantially all of receptacles 32 and 34 from one sidewall 24 to the other. Peripheral member 22 and removable insert 10 are apportioned such that most of the weight of the wearer will be borne by insert 10. Insert 10 has a transverse slot 42, formed by eliminating elements 40, corresponding to the transverse reinforcing segment 30.

Base member 38 has an upper surface 44 onto which a flocking material 46, which is preferably formed of a polyester/nylon material but can be formed of any suitable fabric, is joined as by gluing. As finished out by flocking material 46, insert 10 would not require any insole or liner on top of it to be suitable for wearing.

As shown, base member 38 has a central member 48, and a lip member 50 that extends beyond central area 48. Cushioning elements 40 depend from central member 48. Lip member 50 is formed to be coextensive with top surface 26 of peripheral member 22. A uniform cushionable upper surface 44 is therefore presented to the wearer's foot throughout the interior of the shoe.

Figure 2:
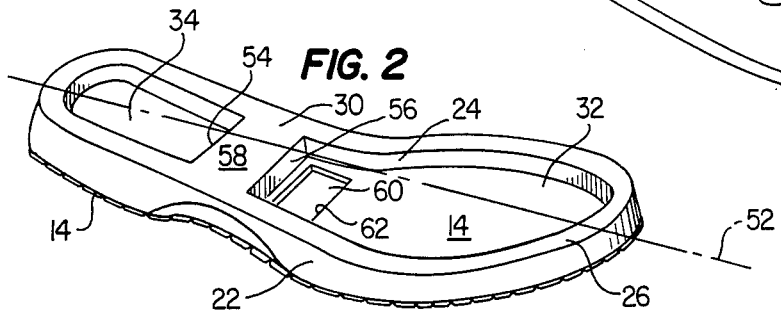
FIG. 2 is a top isometric view of a preferred embodiment of a transverse segment of the invention.

Referring now to FIG. 2, a top isometric view of the outsole 14, the peripheral member 22 and the transverse segment 30 is shown. The segment 30 is joined to opposite sidewalls 24 of peripheral member 22 transverse to a longitudinal axis of the outsole 14 as indicated by line 52. In a preferred embodiment, segment 30 comprises a first generally vertical transverse surface 54 and a second generally vertical transverse surface 56 spaced apart from first surface 54. A generally horizontal transverse surface 58 connects first surface 54 to second surface 56. The area thus formed by surfaces 54-58 forms a solid block of cushionable material for supporting a wearer of shoe 12.

Positioned proximate the segment 30 is a generally transparent window 60 which is molded into a void or aperture 62 formed by walls in the outsole 14. The window 60 may be formed from a clear plastic elastomeric material such as is available from E. I. du Pont de Nemours. It is preferable to recess the window 60 into outsole 14, for example, 2 millimeters, to prevent scuffing or abrasion to the window 60 which would obscure the view therethrough. The window 60 provides for observation or inspection of the elements 40 of insert 10 from exterior the shoe 12.

It is to be understood that segment 30 and window 60 may be located in different positions and different orientations. For example window 60 may be parallel or oblique to axis 52 rather than transverse thereto. A window 60 may also be positioned along the peripheral member 22 as will be subsequently described in more detail. Additionally, a plurality of transverse segments 30 and a plurality of observation windows 60 may be provided.

Figure 3:
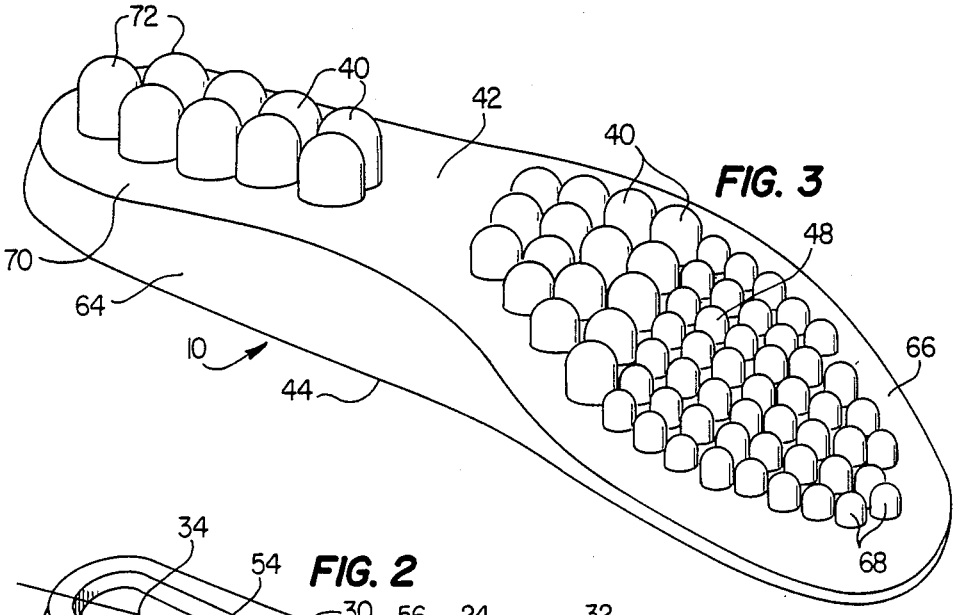
FIG. 3 is a bottom isometric view of a preferred embodiment of a custom midsole insert of the invention.

Referring now to FIG. 3, a bottom isometric view of insert 10 is shown. In the illustrated embodiment, insert 10 is integrally formed with an insole portion 64. In the embodiment shown in FIG. 3, upper surface 44 comprises the upper surface of insole portion 64, and the flocking material 46 (FIG. 1) is joined to this surface.

In the embodiment illustrated in FIGS. 1 and 3, elements 40 each take the form of a pillar with a rounded free end. Elements 40 are formed in central area 48 in a closest packing arrangement in order to provide cushionable support throughout central area 48. Elements 40 are formed independently of each other, and are only joined to base 38. In this manner, elements 40 provide in effect a multiple-point independent suspension. This is because elements 40 will be compressed and will yield independently of each other. This is an advantage over midsoles or insoles of solid construction, which have a tendency to yield and compress continuously and uniformly over large areas. The discrete elements 40 on the other hand give an independent, discontinuous support to different portions of the foot that is not obtainable by a midsole or insole of uniform construction.

Elements 40 are graduated in size in order to conform to the depth of sidewall 24 (FIG. 1). In a front area 66 of area 48, a plurality of relatively small elements 68 are formed. Elements 68 will conform to the relatively thin depth of peripheral member 22 in the front region. In heel region 70, a relatively small number of large heel cushioning elements 72 are formed. The larger size of elements 72 adapts them to the larger depth of peripheral member 22 in heel region 70. Further, since there is a larger cushioning depth of material, the larger size of elements 72 prevents undue bending or nonradial deformation, as might otherwise occur if a plurality of long, thin elements were used.

A transverse slot 42 is formed into insert 10 by eliminating elements 40 corresponding to the transverse reinforcing segment 30. The transverse slot 42 divides insert 10 into front area 66 and heel region 70 that fit into receptacles 32 and 34 respectively. The division into front area 66 and heel region 70 greatly reduces or eliminates slippage of the insert 10 within the receptacles 32 and 34. The combination of transverse reinforcing segment 30 and transverse slot 42 reduces any bounce or heel vibration caused by a springboard effect of the elements 40.

Figure 4:
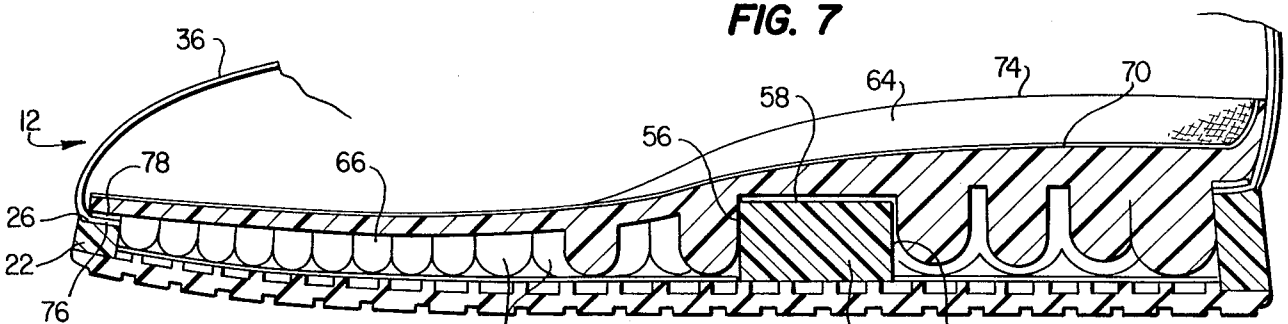
FIG. 4 is a longitudinal section taken substantially along line 4—4 of FIG. 1.

Referring now to FIG. 4, a longitudinal section taken substantially along line 4—4 of FIG. 1 is shown. FIG. 4 particularly illustrates the graduated size of elements 40 from front area 66 to heel region 70. Some of the elements 40 are not shown in section because section line 4—4 did not pass through them, or are shown only partially in section because line 4—4 did not pass through them along their major diameter. Insole portion 64 is shown to have a concave surface 74 in heel region 70 for the support of the heel of the wearer's foot.

Upper 36 has a bottom lip member 76 for mating with upper surface 26 of peripheral member 22. Lip member 76 is attached as by gluing to upper surface 26. Then, an element 78 is placed on top of lip member 76. Element 78 is elongate and extends around the periphery of shoe 12, corresponding to upper surface 26. Element 78 can conveniently be formed of the leatherized paper material preferably forming reinforcing layer 28, or from another relatively strong material. Stitching (not shown) is used to join element 78, lip member 76 and peripheral member 22, and optionally outsole 14, together.

In operation, shoes 12 and inserts 10 are distributed to retailers as separate items. Each insert 10 has a specific durometer reading that measures its relative yieldability or resiliency. The cushionability of inserts 10 can also be varied by changing the shape and/or spacing of elements 40. A plurality of different inserts 10 having a range of durometer readings are provided for each shoe size, such that any pair or numerous pairs of inserts 10 can be inserted into a respective pair of shoes 12. A particular pair of inserts 10 are selected for a particular customer according to the customer's weight and cushioning preference. Thus, a lightweight person will in general require an insert 10 that is more cushionable and less resilient than a heavier person. Further, the customer may have a particular preference concerning how "soft" or "hard" the shoe feels, and may select a pair of inserts 10 that match his or her preferences in this respect. Finally, there may be medical reasons for selecting a right insert 10 that has a different resiliency and cushionability than a left insert 10, and the invention will permit this selection.

Figure 6:
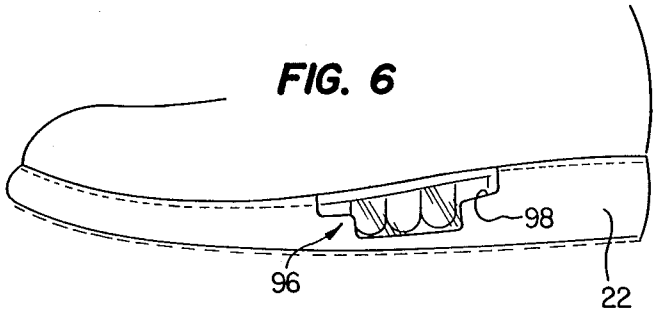
FIG. 6 is a longitudinal section of an additional alternate embodiment of the present invention.
Figure 7:
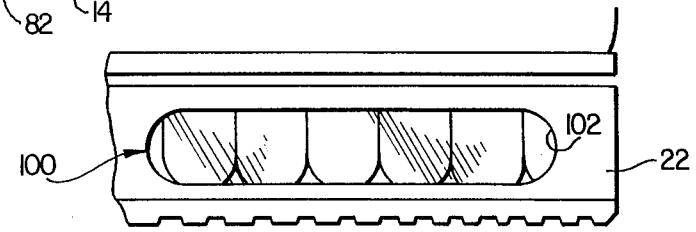
FIG. 7 is a partial longitudinal section of a still further alternate embodiment of the present invention.
Figure 5:
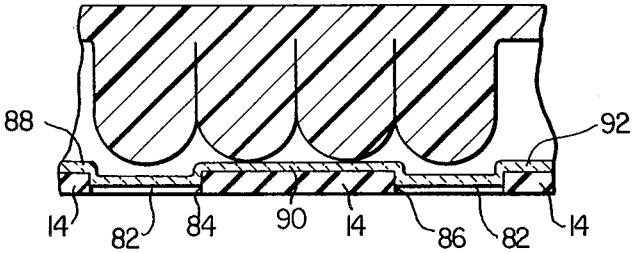
FIG. 5 is a partial longitudinal section of an alternate embodiment of the present invention.

Referring now to FIGS. 5, 6 and 7, alternate embodiments of a transparent window constructed according to the invention is illustrated. Referring first to FIG. 5, a window 82 is illustrated in cross-section. Window 82 comprises a generally transparent material and is positioned in a void or aperture 84 and 86 formed by walls through outsole 14. The window 82 is recessed into the outsole 14 approximately 2 millimeters to help reduce scuffing or abrasion to the transparent material. The voids 84 and 86 are preferably cut through the outsole 14 to remove any obstacles to a clear view of the interior of the shoe. The transparent material comprising window 82 is then formed to match the voids 84 and 86 and have overlaps 88, 90 and 92 to allow for securing to outsole 14. Window 82 is secured by any appropriate method such as gluing to reestablish the integrity of outsole 14.

Referring to FIGS. 6 and 7, side window alternatives are shown in elevational view. In FIG. 6, an irregularly shaped window 96 is formed through a void or aperture 98 defined by walls in peripheral member 22. In FIG. 7, an oval shaped window 100 is formed through a void 102 in peripheral member 22. Windows 96 and 100 may have overlap areas similar to 88 and 92 (FIG. 5) to allow for glue attachment or may be configured to clip into place.

In summary, a novel midsole with a custom insert has been provided in order to vary the resiliency and cushionability of the midsole according to the wearer's needs. A transverse segment is positioned between the heel and the front portion of the shoe to add stability and support to the wearer. The transverse segment helps reduce heel bounce and slippage found to exist with a shoe insert. Finally, windows are provided in either the outsole or the peripheral member to allow interior observation from exterior the shoe.

While preferred embodiments of the invention and their advantages have been described above, the invention is not limited thereto but only by the spirit and scope of the claims which follow.

What is claimed is:

1. In a shoe, a combination comprising:

a sole portion for the shoe;

walls defining an aperture through said sole portion;

cushioning elements overlying said sole portion in order to provide cushioning support to the foot of the wearer, said cushioning elements having a plurality of curved cushions depending downwardly and providing distinctive visual design aspects; and a transparent plastic material filling said aperture such that said plastic material seals to make an integral shoe, said transparent plastic material allowing the ability to see through said sole portion to externally observe at least a portion of said curved cushions having said distinctive visual design aspects overlying said sole portion.

2. The shoe of claim 1, wherein said sole portion includes an outsole, said aperture extending through said outsole in order to enable viewing of the underside of said cushioning elements.

3. The shoe of claim 1, wherein said sole portion includes a midsole, said aperture extending through a side of said midsole in order to enable viewing of side portions of said cushioning elements.

4. The shoe of claim 1, wherein said cushioning elements comprise a removable midsole insert with a plurality of visually distinctive cushioning elements on the underside thereof.

5. The shoe of claim 1, wherein said sole portion comprises a midsole affixed to an outsole and further comprising a reinforcement segment transversely disposed over said outsole and within said midsole to inhibit movement of said cushioning elements within the shoe.

6. In a shoe, a combination comprising:

a durable outsole;

a midsole bonded to said outsole, said midsole forming a receptacle;

an insert fitting within said receptacle, said insert comprising cushioning elements which overlie said outsole to provide cushioning support to the foot of the wearer, said cushioning elements having a plurality of curved cushions depending downwardly and providing distinctive visual design aspects; and an aperture filled with a transparent plastic formed from the exterior of the shoe into said receptacle to enable visual inspection of said distinctive visual design aspects of said insert.

7. The shoe of claim 6, wherein said aperture extends through said outsole.

8. The shoe of claim 6, wherein said aperture extends through a side of said midsole.

9. The shoe of claim 6, further comprising:

a transverse reinforcing segment formed with said midsole and attached to said outsole, said segment providing support and stability to a wearer of the shoe; and a transverse slot in said removable insert to interfit with said transverse segment.

* * * * *